US007438066B2

(12) United States Patent
Michalske et al.

(10) Patent No.: US 7,438,066 B2
(45) Date of Patent: Oct. 21, 2008

(54) METHOD AND DEVICE FOR CONTROLLING AN INTERNAL COMBUSTION ENGINE

(75) Inventors: Andreas Michalske, Leonberg (DE); Sascha-Juan Moran Auth, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 48 days.

(21) Appl. No.: 11/378,989

(22) Filed: Mar. 17, 2006

(65) Prior Publication Data

US 2006/0207583 A1 Sep. 21, 2006

(30) Foreign Application Priority Data

Mar. 21, 2005 (DE) ..... 10 2005 012 950

(51) Int. Cl.
*F02D 41/00* (2006.01)
*F02M 51/00* (2006.01)

(52) U.S. Cl. ..... 123/674; 123/679; 123/488

(58) Field of Classification Search ..... 123/674, 123/679, 488, 486
See application file for complete search history.

(56) References Cited

U.S. PATENT DOCUMENTS 5,251,598 A * 10/1993 Wietelmann ..... 123/339.21
5,317,868 A * 6/1994 Blischke et al. ..... 60/274
6,161,383 A * 12/2000 Aschner et al. ..... 60/602
7,134,429 B2 * 11/2006 Mader et al. ..... 123/703

FOREIGN PATENT DOCUMENTS

DE 195 28 696 2/1997
DE 103 16 185 11/2003

* cited by examiner

*Primary Examiner*—John T Kwon
(74) *Attorney, Agent, or Firm*—Kenyon & Kenyon LLP

(57) ABSTRACT

A method and device for controlling an internal combustion engine, in which the fuel quantity to be injected into the engine is limited to a limiting value. The limiting value is predefined on the basis of the output signal of a closed-loop controller or an open-loop controller and a precontrol value. Furthermore, the precontrol value is corrected.

7 Claims, 3 Drawing Sheets

METHOD AND DEVICE FOR CONTROLLING AN INTERNAL COMBUSTION ENGINE

BACKGROUND INFORMATION

German Patent No. DE 103 16 185, for example, describes a method and a device for controlling an internal combustion engine, in which the fuel quantity to be injected into the engine is limited to a limiting value. In that document, a closed-loop controller emits a controller output signal on the basis of the deviation between a setpoint value and an actual value of a lambda signal. An open-loop controller predefines a precontrol value for the limiting value on the basis of performance characteristics, the precontrol value being gated with the closed-loop controller output signal for forming the limiting value. Alternatively, an open-loop controller may be used instead of a closed-loop controller.

SUMMARY OF THE INVENTION

In particular, during acceleration or when starting off, smoke emissions occur when such a device is used. It has been recognized according to the present invention that these smoke emissions are due to the fact that the injectors normally used for fuel injection change in their characteristics over their lifetime. In particular, the fuel quantity for a constant control signal increases over the lifetime. It is furthermore recognized according to the present invention that, at least in low gears, the adjustment time using the closed-loop controller is excessively long, i.e., the controller is incapable of satisfactorily counteracting smoke emissions at start. The controller cannot be designed to act faster due to the gas transport time and the associated inertia in the control loop.

Therefore, according to the present invention, the precontrol value is adaptively corrected. For this purpose, correction values are ascertained in an appropriate manner to compensate for these effects. These correction values are saved and subsequently used for correcting the precontrol. It is advantageous in particular that the precontrol is additively and/or multiplicatively corrected. This procedure is also applicable when open-loop control is used instead of closed-loop control.

The controller ascertains the output signal on the basis of a comparison between an expected lambda value and an actual lambda value. The lambda values are a very accurate measure of the injected fuel quantity. If the fuel quantity differs from the desired value in such a way that increased emissions possibly occur, this can be recognized even in the case of minor deviations. The use of the closed-loop controller allows the limiting value to be very accurately ascertained.

It is advantageous in particular if the correction value is additively and/or multiplicatively superimposed on the precontrol value. The correction value is easily added to or multiplied by the precontrol value, requiring little resources in the control unit. The correction is especially flexible when both additive and multiplicative correction values are ascertained and used.

It is advantageous when the correction value is predefinable on the basis of a lambda value. An exact signal already available in the control unit is used for ascertaining the correction value. No additional sensor is required.

In a particularly advantageous first embodiment, correction values which are used for correcting other performance characteristics are used for ascertaining the correction values for precontrol. This means that adaptation correction values for correcting a desired quantity signal are predefined on the basis of a measured lambda value and an air flow value.

Correction value K is ascertained on the basis of these adaptation correction values. In this embodiment, the correction value is ascertained indirectly, via the correction values of another correction, on the basis of the lambda value.

In another particularly advantageous embodiment, the ratio between the desired lambda value and the actual lambda value is formed. In certain operating states, the variation over time of both lambda values is considered, and only the minimum values of both quantities are used. Full-load operation is used as the operating state. In this embodiment the correction values are ascertained directly from the lambda value.

DETAILED DESCRIPTION

Figure 1A:
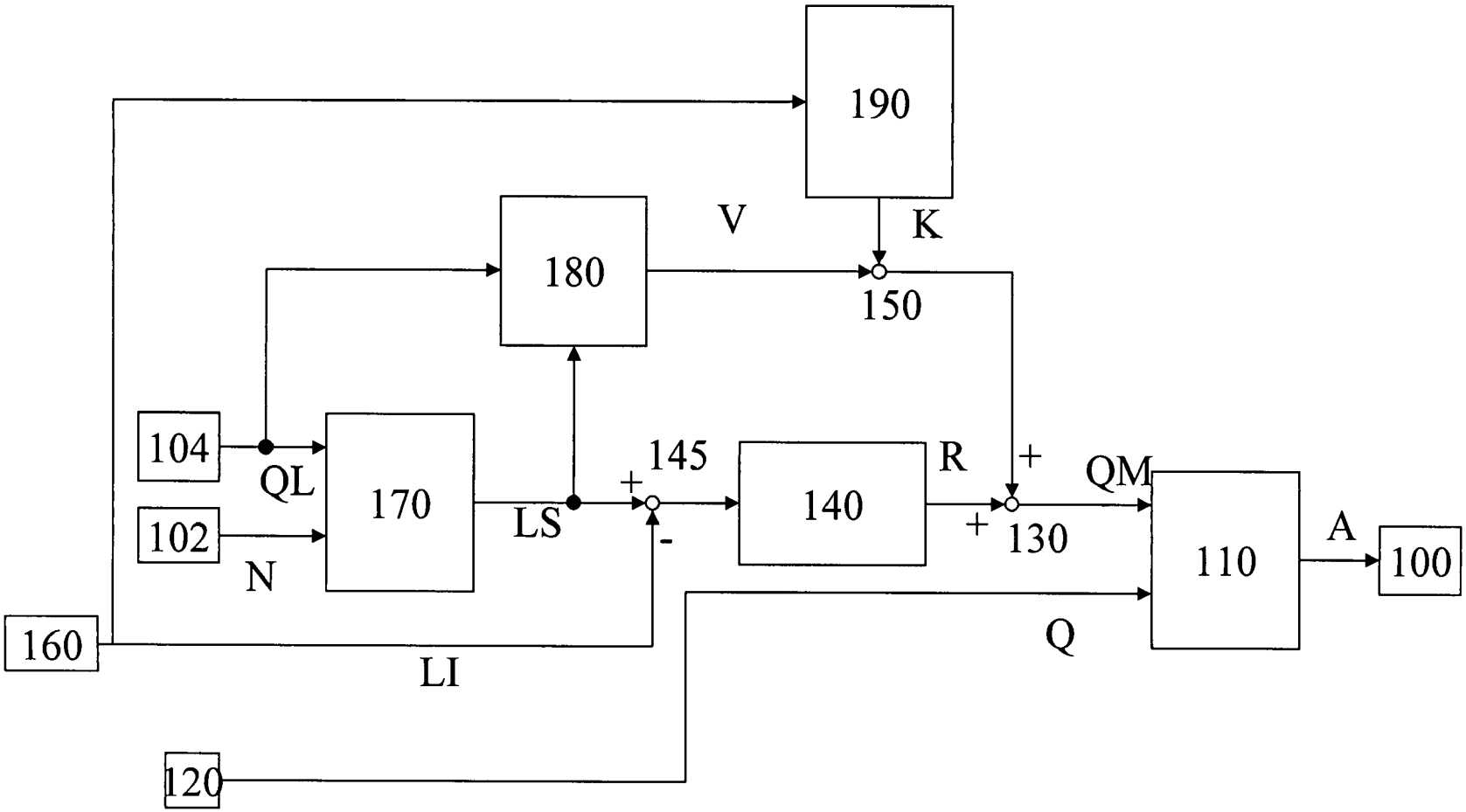
FIGS. 1*a* and 1*b* show block diagrams of the device according to the present invention.
Figure 1B:
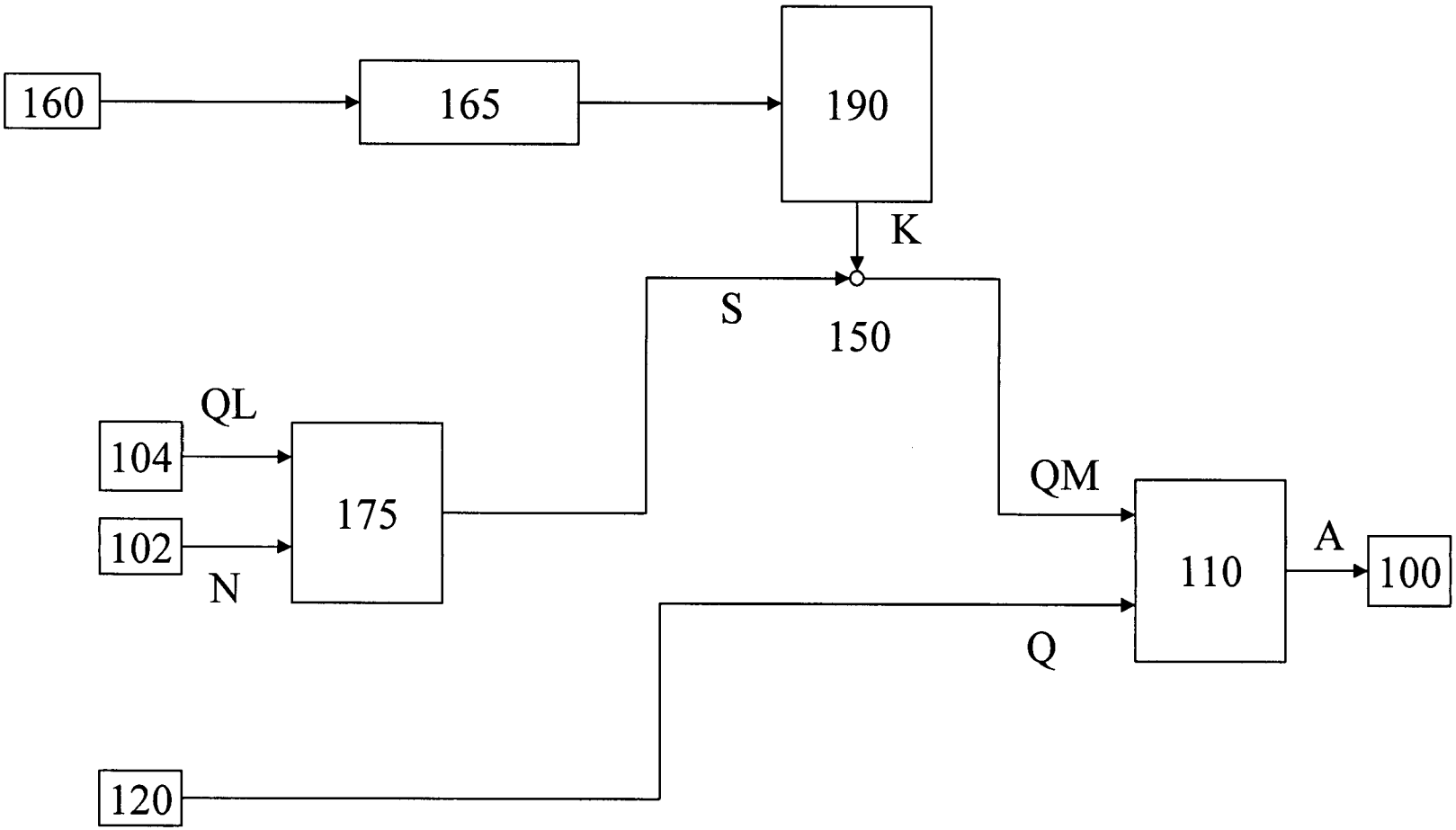

FIGS. 1*a* and 1*b* show the important elements of a device for controlling an internal combustion engine as a block diagram. A flow controller 100 receives a trigger signal A from a minimum selection element 110. Minimum selection element 110 receives output signal Q of a quantity predefinition element 120 and the output signal of a node 130. Output signal QM of node 130 is a limiting value to which output signal Q of quantity predefinition element 120 is limited by minimum selection element 110. Node 130 receives the output signal of a controller 140 and the output signal of a node 150. The controller receives the output signal of a comparison point 145, whose one input receives a negative signal LI, which is provided by a lambda sensor 160. Second input of comparison point 145 receives output signal LS of a smoke limiting characteristics map 170. Output signal LS of the smoke limiting characteristics map is also supplied to a precontroller 180. Smoke limiting characteristics map 170 receives different signals of different sensors such as, for example, a rotational speed signal N of a rotational speed sensor 102 and other controlled variables such as a signal QL which characterizes the desired and/or actual air flow supplied to the engine. The latter is provided by an air controller 104 in particular. Signal QL for the air flow is also supplied to precontroller 180. Precontroller 180 in turn supplies its signal to node 150. Output signal K of correction value predefinition element 190 is applied to the second input of node 150. Correction value predefinition element 190 receives other signals such as signal LI of the lambda sensor. Node 150 gates the signals preferably additively and/or multiplicatively.

Quantity predefinition element 120 predefines a desired fuel quantity Q to be injected on the basis of at least the driver's intent, which is detected with the aid of an accelerator pedal, for example. It is limited by minimum selection element 110 to limiting value QM, which is also referred to hereinafter as maximum allowed fuel quantity QM. This maximum allowed fuel quantity QM is usually predefined in such a way that no illegal operating states and/or illegal harmful emissions such as smoke occur. The output signal of the minimum selection element is then used for triggering the flow controller. The flow controller is preferably designed as an injector of a common rail system.

The maximum allowed quantity QM is predefined in particular by a precontroller 180 on the basis of air flow QL. In addition to the air flow, further quantities which characterize the environmental conditions and/or the operating state of the engine may also be used.

On the basis of air flow QL and additional quantities such as, for example, setpoint value LS for the lambda signal, precontroller 180 calculates a precontrol value V, which specifies the highest allowable fuel quantity. On the basis of this precontrol value V and the output signal of lambda controller 140, node 130 forms limiting value QM. The two signals are preferably gated additively. However, other types of gating of the two signals, in particular multiplicative gating, may also be provided.

Based on the comparison between setpoint value LS and actual value LI for the lambda signal, this lambda controller 140 outputs a value which is used for limiting the fuel quantity. Precontrol value V is preferably corrected as needed on the basis of the controller output signal. The precontrol has the advantage that, in operating states in which no closed-loop control is possible or appropriate, at least the precontrol value is available. This is the case in particular when starting the engine when the lambda sensor has not yet reached its operating temperature.

Smoke limiting characteristics map 170 predefines a setpoint value LS for the lambda signal as a function of different performance characteristics such as air flow and rotational speed. Controller 140 subsequently calculates an output signal on the basis of the comparison with the actual lambda signal. Minimum selection element 110 then limits fuel quantity Q to be injected to the limiting value thus formed. Flow controller 100 then receives the output signal of the minimum selection element.

According to the present invention, precontrol value V is corrected in node 150 with the aid of a correction value K, which is provided by correction value predefining element 190. In a simple embodiment, additive gating is performed in the node. This means that correction value K is added to precontrol value V. In a second embodiment, the correction value is provided as a multiplicative factor by which precontrol value V is multiplied. An additive and a multiplicative correction may also be performed. This means that correction value predefining element 190 determines and saves the correction value in the presence of certain operating states in which this is possible. The correction value may then be used for the correction in all operating states. Correction is therefore possible even in operating states in which it is impossible to determine a correction value.

Dynamic advantages, i.e., lower exhaust gas emissions during acceleration, occur thanks to this procedure, in particular in lower gears. Furthermore, the correction may be performed even in operating states in which the lambda sensor is not yet ready for operation.

In one embodiment of the procedure according to the present invention, only open-loop control is provided instead of closed-loop controller 140. Such an embodiment is depicted in FIG. 1*b*. Elements described in FIG. 1*a* are identified with the same reference numerals. This embodiment differs from that of FIG. 1*a* essentially in that comparison point 145, closed-loop controller 140, and node 130 are omitted. Smoke limiting characteristics map 170 and precontroller 180 are replaced by predefining element 175. This predefining element 175 predefines a controlled variable S as a function of different performance characteristics such as air flow and rotational speed; the controlled variable may then be corrected using correction value K. Predefining element 175 predefines a base value for the controlled variable, which is designed for a tolerance-free engine. Correction predefining element 190 delivers correction value K which compensates the tolerances of the real engine. Limiting value QM is applied to the output of node 150 and is used by minimum selection element 110 for limiting the fuel quantity to be injected.

In the embodiment described in FIG. 1*a*, a raw value V for limiting value QM is predefined on the basis of a closed-loop control, which is based on a lambda signal, and a precontrol. In the embodiment described in FIG. 1*b*, raw value S for limiting value QM is only predefined by an open-loop controller. This raw value is then corrected with the aid of a correction value K. The corrected raw value is used as limiting value QM.

In the following a first embodiment for ascertaining correction value K is described using the example of a correction factor. The procedure is not limited to a correction factor using which multiplicative correction is performed in node 150. A similar procedure may also be used in the case of an additive correction value. Minimum values of desired lambda value LS and actual lambda value LI are ascertained during a full-load acceleration. When minimum actual value LIM is less than minimum setpoint value LSM, the engine is being operated with an excessively rich mixture. In this case, limiting value QM for future full-load accelerations is corrected by correction factor K to smaller values. A correction factor of less than one is preferably used, and the precontrol value is multiplied by this value in node 150. For reasons of statistical relevance and driving comfort, the deviation is not compensated from one full-load acceleration to the next, but only gradually.

The following procedure is used for ascertaining correction factor K. Correction factor K is set at 1 when the vehicle is first started. If a full-load acceleration is detected, minimum values LIM and LSM of the actual lambda value and the setpoint lambda value are determined during the full-load acceleration. This means that both lambda values are measured over a certain period of time and the smallest particular value occurring during that period of time is used as minimum value LIM or LSM. Based on minimum value LIM of the actual lambda value and minimum value LSM of the setpoint lambda value, ratio R between minimum value LIM of the actual value and minimum value LSM of the setpoint value is calculated using the formula:

$$R=LIM/LSM$$

Correction factor K is calculated based on this ratio R. In a simple embodiment, value R may be used directly as correction factor K.

Value R corresponds to the ratio between the maximums of the desired injection quantity and the actual injected fuel quantity. An injection quantity error is preferably ascribed to a positive injector drift. However, the method also works in the case of an air mass error which may be interpreted as a fuel quantity error. In either case, the fuel quantity is excessive for the available quantity of fresh air. Precontrol value V and thus smoke limitation is reduced by value R.

The change in correction factor K is limited to the value 1−E. Correction factor K is therefore reduced by a maximum of E*100% after each full-load acceleration. The following formula may be used, for example, for calculating the limited correction factor KB1:

$$KB1=K^{*}\mathrm{MAX}((I-E),\ \mathrm{MIN}(R,1))$$

This means that a check is performed of whether value R is less than 1. If this is the case, it is checked whether R is greater than 1−E. If this is the case, value R is used. This means that R assumes values between 1−E and 1, where E is greater than zero and considerably less than 1. Due to the fact that E is considerably less than 1, the change in the correction value is limited to a maximum possible value.

The absolute value is then limited to a maximum of 1 and a minimum of 1−L. This is accomplished using the formula:

$$KB2=\mathrm{MAX}((1-L),KB1)$$

By limiting to a maximum of 1, it is ensured that the smoke limitation quantity is not raised when the actual value is greater than the setpoint value.

In one embodiment correction factor K is increased in defined intervals. The intervals may be time intervals or selected as a function of the driving performance, in particular the route segment traveled. The raised value KA for correction factor K is calculated from instantaneous value K according to the following formula:

$$KA=\mathrm{MIN}(1,K*(1+X))$$

X assumes values between 0 and 1. These values are preferably much less than 1.

This ensures that, if the drift is reversed, correction factor K does not remain at the smallest value ever assumed. It is raised to 1 as a maximum. An unjustified increase is canceled by the algorithm.

In another, particularly advantageous embodiment, correction value K is determined on the basis of values of a quantity average adaptation. Such a quantity average adaptation element learns injection quantity errors at defined operating points. For this purpose, a fuel quantity QI is calculated on the basis of the lambda signal and the measured air flow, and compared with the desired fuel quantity Q. On the basis of this comparison, adaptation values are ascertained and saved in an adaptation characteristics map as a function of operating point BP. According to the present invention it is recognized that there is a good correlation between the quantity errors at the smoke limit and the adaptation values at defined operating points. According to the present invention, correction value K is therefore ascertained on the basis of the adaptation values, in particular of the adaptation values at defined operating points.

In this embodiment, the correction values are a direct function of lambda signal LI, since the lambda signal is used for quantity average adaptation and is thus determined indirectly via the adaptation values of the quantity average adaptation element. This is illustrated in FIG. 1*b* by signal LI being supplied to correction predefining element 190 via quantity average adaptation element 165.

In quantity average adaptation, injection quantity errors are preferably saved in a characteristics map as a function of the operating point. The operating point is preferably defined by the rotational speed and/or the injected quantity. Therefore, according to the present invention, correction quantity K is ascertained from the adaptation correction values at certain interpolation points. Operating points for high fuel quantities are preferably used as operating points.

In a first embodiment, an average relative quantity error X is determined at a plurality of operating points on the basis of the adaptation correction values. The value K=1/(1+X) is then used as the correction factor. The average quantity error X is determined by forming the average over a plurality of adaptation correction values AK at selected operating points. Operating points at which injection quantity errors similar to those at full load are expected are preferably selected. These are, in particular, operating points at which the fuel quantity assumes values which only insignificantly differ from the limiting values.

In another embodiment an average absolute error is calculated. This value is then subtracted from the precontrol value.

Figure 2:
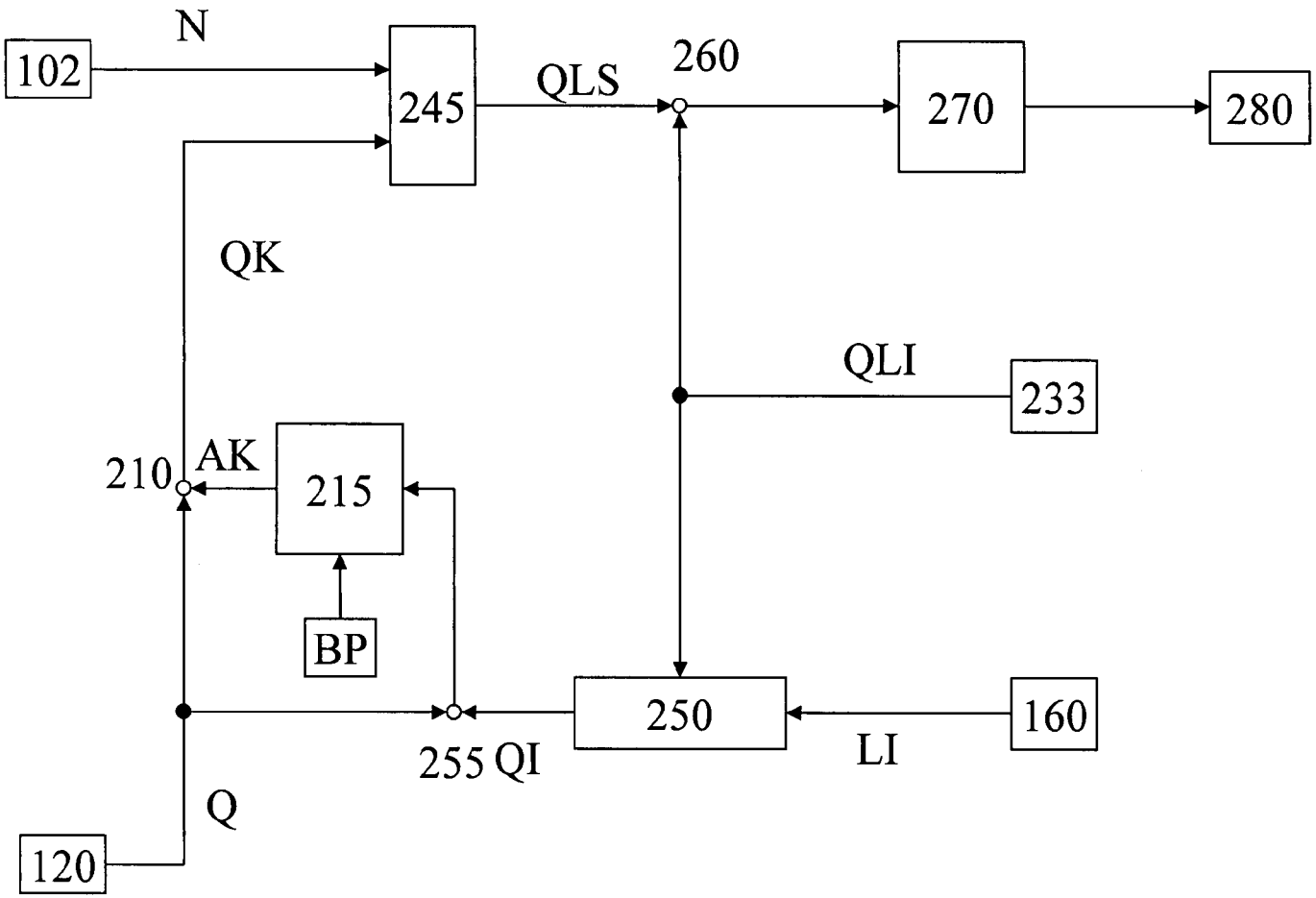
FIG. 2 shows a block diagram for illustrating the mode of ascertaining the correction values.

FIG. 2 shows the important components of a quantity average adaptation element. Components described in FIGS. 1*a* and 1*b* are identified with the same reference numerals. Output signal N of speed sensor 102 is supplied to a setpoint value predefinition element 245, while output signal QK of a node 210 is applied to the second input of setpoint value predefinition element 245. Output signal Q of quantity predefinition element 120 and the output signal of a adaptation element 215 are applied to the inputs of node 210. Quantity predefinition element 120 predefines the fuel quantity as a function of the driver's intent. Output signal Q of the quantity predefinition element is also supplied to a node 255; the output signal QI of a quantity calculating element 250 is supplied to the second input of node 255. Adaptation element 215 receives the output signal of node 255. The adaptation element also receives one or more signals BP, which characterize the operating point. These are provided by sensors, for example.

Quantity calculating element 250 receives output signal LI of lambda sensor 160 and the output signal QLI of an air flow meter 233.

Output signal QLI of air flow meter 233 is also supplied to a node 260. Output signal QLS of setpoint predefinition element 245 is applied to the second input of node 260. The output signal of node 260 is supplied to an actuator 280 via an air flow regulator 270 for influencing the quantity of fresh air.

On the basis of the comparison between signal QLS and signal QLI, which corresponds to the difference between the desired air flow and the actually supplied air flow, air flow regulator 270 determines a control signal for actuator 280. Setpoint value predefinition element 245 calculates this setpoint value on the basis of different performance characteristics such as, for example, rotational speed N and/or the injected fuel quantity QK. The injected fuel quantity QK is derived from the above-described node 210.

Based on the actually supplied air flow QLI, which is measured by air flow meter 233, and exhaust gas lambda signal LI, quantity calculating element 250 calculates an actually injected fuel quantity. This variable is gated with desired quantity Q in node 255. On the basis of this comparison, different adaptation correction values AK are ascertained and saved in adaptation element 215 as a function of operating point BP. Fuel quantity Q is corrected in node 210 as a function of the operating point using these adaptation correction values AK. This means that for each operating point, which is preferably defined by the rotational speed and/or the injected fuel quantity, an adaptation correction value AK is saved in adaptation characteristics map 215 for correcting the fuel quantity to be injected. The operation of such a device is described in more detail in German Patent No. DE 195 28 696. The quantity errors are saved in adaptation characteristics map 215 as a function of the operating point.

The correction values AK are advantageously limited as described for the first exemplary embodiment.

Correction values K ascertained according to the above-described procedure may be used, in principle, for an additive and/or multiplicative correction. In the case of an additive correction, the limitation is to be adapted as appropriate.

Combining the individual embodiments for ascertaining the correction values is advantageous in particular. Different correction procedures may be used for different operating points. Other procedures different from those used for multiplicative correction values may be used for ascertaining the additive correction values.

What is claimed is:

1. A method for controlling an internal combustion engine, comprising:

limiting a fuel quantity to be injected into the internal combustion engine to a limiting value, the limiting value being predefined as a function of an output signal of a closed-loop controller and a precontrol value; and correcting the precontrol value;

wherein the correcting includes at least one of additively and multiplicatively superimposing a correction value on the precontrol value, and wherein adaptation correction values are predefined as a function of an actual lambda value and an air flow value for correcting a desired quantity signal, the correction value being ascertained as a function of the adaptation correction values.

2. The method according to claim 1, further comprising using the closed-loop controller to ascertain the output signal as a function of a comparison between an expected lambda value and an actual lambda value.

3. The method according to claim 1, wherein the correction value is predefined as a function of a lambda value.

4. The method according to claim 1, further comprising determining the correction value as a function of a ratio between minimum values of expected lambda values and of actual lambda values.

5. The method according to claim 1, further comprising limiting the correction value to a maximum possible value.

6. The method according to claim 1, further comprising limiting a change in the correction value to a maximum possible value.

7. A device for controlling an internal combustion engine comprising:

a fuel quantity limiting arrangement for limiting a fuel quantity to be injected into the internal combustion engine to a limiting value, the limiting value being predefined as a function of an output signal of a closed-loop controller and a precontrol value; and a precontrol value correcting arrangement for correcting the precontrol value;

wherein the correcting includes at least one of additively and multiplicatively superimposing a correction value on the precontrol value, and wherein adaptation correction values are predefined as a function of an actual lambda value and an air flow value for correcting a desired quantity signal, the correction value being ascertained as a function of the adaptation correction values.

* * * * *